US010335817B2

(12) United States Patent
Bellante et al.

(10) Patent No.: US 10,335,817 B2
(45) Date of Patent: Jul. 2, 2019

(54) SYSTEM FOR SPRAYING A DISPENSABLE MATERIAL AND METHODS RELATING THERETO

(71) Applicant: S. C. JOHNSON & SON, INC., Racine, WI (US)

(72) Inventors: Jonathan D. Bellante, Dallas, TX (US); Mark J. Van Handel, Greendale, WI (US); Matthew M. Petkus, Lake Villa, IL (US); Hua Han, Evanston, IL (US); Bradley J. Barron, Chicago, IL (US); Kimberly L. Smolko, Racine, WI (US); Jacob Palmborg, Brooklyn, NY (US); Charles Paradise, Brooklyn, NY (US); Philip Randolph Hartley, Brooklyn, NY (US); Evan M. Allen, New York, NY (US); Ayca Cakmakli, San Francisco, CA (US); Richard Whitehall, New York, NY (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 15/025,083

(22) PCT Filed: Sep. 26, 2014

(86) PCT No.: PCT/US2014/057820
§ 371 (c)(1),
(2) Date: Mar. 25, 2016

(87) PCT Pub. No.: WO2015/048519
PCT Pub. Date: Apr. 2, 2015

(65) Prior Publication Data

US 2016/0236219 A1 Aug. 18, 2016

Related U.S. Application Data

(60) Provisional application No. 61/883,118, filed on Sep. 26, 2013.

(51) Int. Cl.
*B65D 83/68* (2006.01)
*B05B 11/00* (2006.01)
(Continued)

(52) U.S. Cl.
CPC ..... *B05B 11/3084* (2013.01); *B05B 7/0408* (2013.01); *B05B 7/2464* (2013.01);
(Continued)

(58) Field of Classification Search
CPC ..... B05B 11/3081; B05B 11/0078; B05B 11/0081; B05B 11/0083; B05B 11/0008;
(Continued)

(56) References Cited

U.S. PATENT DOCUMENTS 2,825,492 A * 3/1958 Krasno ..... G01F 11/08 222/209
2,925,939 A * 2/1960 Spero ..... B65D 83/685 141/383
(Continued)

FOREIGN PATENT DOCUMENTS

CN 1902103 A 1/2007
DE 10 2006 029 345 A1 12/2007
(Continued)

OTHER PUBLICATIONS

International Search Report and Written Opinion of the International Searching Authority issued in PCT/US2014/057820, dated Jan. 31, 2015; 15 pages.
(Continued)

*Primary Examiner* — Patrick M. Buechner

(57) ABSTRACT

According to one aspect of the invention, a method for directing the use of a sprayer includes the step of directing a user to affix a sprayer to a neck of a water bottle (114) via an attachment mechanism (112). The method further includes the step of directing the user to adjust the attach-
(Continued)

ment mechanism (112) to change the internal geometry thereof and attach the sprayer to the neck of the bottle.

10 Claims, 5 Drawing Sheets

(51) Int. Cl.
*B05B 7/04* (2006.01)
*B05B 7/24* (2006.01)

(52) U.S. Cl.
CPC ..... *B05B 11/0078* (2013.01); *B05B 11/3014* (2013.01); *B05B 11/3081* (2013.01); *B05B 11/3083* (2013.01); *B65D 83/685* (2013.01); *B05B 7/2472* (2013.01); *B05B 11/0008* (2013.01)

(58) Field of Classification Search
CPC ..... B05B 11/0054; B05B 11/3009; B05B 11/3014; B05B 11/3043; B05B 11/3057; B05B 11/3083; B05B 11/3084; B05B 11/3085; B05B 7/0408; B05B 7/2464; B05B 7/2472; B65D 83/66; B65D 83/685
See application file for complete search history.

(56) References Cited

U.S. PATENT DOCUMENTS 3,291,346 A * 12/1966 Marraffino ..... B65D 83/685 222/136
3,298,611 A * 1/1967 Marraffino ..... B65D 83/44 222/144.5
3,300,095 A * 1/1967 Maraffino ..... B65D 83/685 222/146.3
3,300,144 A * 1/1967 Marraffino ..... B65D 83/207 222/135
3,300,145 A * 1/1967 Marraffino ..... B65D 83/685 222/135
3,335,961 A * 8/1967 Marraffino ..... B65D 83/685 222/135
3,338,479 A * 8/1967 Marraffino ..... B65D 83/685 222/129
3,341,079 A * 9/1967 Marraffino ..... B01F 3/04007 222/136
3,390,820 A * 7/1968 Marraffino ..... B65D 83/685 222/484
3,404,812 A * 10/1968 Marraffino ..... B65D 83/685 222/402.18
3,638,838 A * 2/1972 Marraffino ..... B65D 83/685 222/129
4,249,674 A * 2/1981 Antenore ..... B65D 83/685 222/153.11
5,711,457 A * 1/1998 Wanbaugh ..... B05B 11/3011 222/136
5,819,987 A * 10/1998 Miller ..... B05B 11/3081 222/135
5,947,335 A * 9/1999 Milio ..... B05B 11/3008 222/133
5,964,377 A * 10/1999 Demarest ..... B05B 11/0051 222/136
9,623,427 B2 * 4/2017 Gilpatrick ..... B05B 1/34
2002/0190139 A1 * 12/2002 Morrison ..... E01C 7/185 239/172
2006/0196885 A1 9/2006 Leach et al.
2007/0138032 A1 6/2007 Agarkov
2008/0001002 A1 * 1/2008 Garon ..... B05B 7/2408 239/67
2008/0314928 A1 * 12/2008 Banco ..... B05B 11/3011 222/145.5
2009/0050706 A1 * 2/2009 Xu ..... B05B 7/2464 239/1
2009/0277928 A1 * 11/2009 Bruckner ..... B05B 11/0078 222/129
2010/0163578 A1 * 7/2010 Mueller ..... B05B 11/0081 222/129
2015/0352571 A1 * 12/2015 Petkus ..... B05B 7/2464 222/1

FOREIGN PATENT DOCUMENTS

EP 1166885 A1 1/2002
EP 2 006 026 A2 12/2008
GB 764564 A 12/1956
WO 99/19075 A1 4/1999

OTHER PUBLICATIONS

Communication pursuant to Article 94(3) EPC, European Application No. 14792916.0, dated Nov. 29, 2017, 5 pages.
Second Office Action (including English translation) issued in corresponding Chinese Patent Application No. 201480062893.0, dated Jan. 30, 2018, 11 pages.
Third Office Action issued in corresponding Chinese Patent Application No. 201480062893.0, dated Aug. 10, 2018, 12 pages.

* cited by examiner

SYSTEM FOR SPRAYING A DISPENSABLE MATERIAL AND METHODS RELATING THERETO

CROSS REFERENCE TO RELATED APPLICATIONS

This application represents the U.S. National Stage of International Application No. PCT/US2014/057820, filed Sep. 26, 2014, which is based on, claims priority to, and incorporates herein by reference in its entirety, U.S. Provisional Patent Application Ser. No. 61/883,118, filed Sep. 26, 2013, and entitled, "System for Spraying a Dispensable Material and Methods Relating Thereto."

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present disclosure generally relates to a system and method for spraying a dispensable substance, and more specifically, to a system and method for using a sprayer system having a material reservoir with a concentrate therein, wherein the sprayer system is designed to be attached to one or more bottles.

2. Description of the Background of the Invention

Household cleaning typically involves a consumer dispensing a substance to accomplish a specific household task. For instance, a consumer may wish to purchase a furniture cleaner, a bathroom cleaner, an air freshener, and/or other types of cleaners that are designed for use in a specific area of the home. In almost all cases, cleaning supplies and other dispensable substances (e.g., insecticide, air freshener, etc.) are sold in individual bottles and/or packages and are designed to be dispensed therefrom until the container is empty. After purchasing the dispensable substance, a consumer stores each of the containers and dispenses the substances as needed. When the bottle is empty, the consumer disposes of the bottle and sprayer and purchases a new container having the desired dispensable substance therein. It is not uncommon for a consumer to have many bottles and containers of dispensable substances in a single household.

The use of numerous cleaning supplies and dispensable substances is convenient to the consumer because each of the dispensable substances serves a specific purpose (e.g., deodorizing, air freshening, cleaning, etc.). However, one drawback to the use of several dispensable substances is that each one is sold in a separate package. The use of individual packages may be undesirable due to space constraints in both retail locations and in the home of the consumer. In particular, dispensable substances occupy significant shelf space in a retail location, which may cause the retail location to be larger, not carry as much stock, and/or be overcrowded with product. Similarly, dispensable substances occupy a significant portion of storage space in a consumer home, which may be particularly problematic in small condominiums in urban areas. An additional drawback associated with the use of dispensable substances is the impact on the environment due to product packaging. In particular, the bottle of each of the dispensable substances must be disposed of after the dispensable substance has been used up.

Some attempts have been made to overcome the aforementioned drawbacks associated with dispensable substances through the use of concentrated dispensable substances. In particular, typical concentrated dispensable substances are sold as a packet that must be mixed with water in a bottle prior to use to form a dispensing system. In these systems, the consumer is usually required to mix an entire batch of the product because the packet is designed to be used with a specific quantity of water. Further, the consumer must utilize one empty bottle for each substance that is to be mixed. After the user mixes the concentrate to form the dispensable substance, the substance may be utilized in a manner consistent with that of the dispensable substances discussed previously herein.

However, the use of concentrated dispensable substances still has numerous drawbacks. For example, consumers are still required to mix the concentrate with water in a separate container and store and/or dispose of the resulting mixture. This process is time consuming, unreliable, and still requires a significant amount of storage space. In particular, the consumer is required to use one spray bottle for each dispensable substance because concentrate products typically require the consumer to create an entire batch, even if the consumer does not need a large quantity of the substance. In instances where a smaller batch may be generated, a consumer still may expend additional time and effort by having to correctly guess the specific amount of substance needed and thereafter prepare additional substance if too little was mixed in the first preparation. Alternatively, the consumer may want to avoid having to mix additional substance by initially mixing extra, which may result in the consumer having to dispose of and/or store the extra amount.

Therefore, there is a need for a system and method that overcomes the aforementioned drawbacks. In particular, there is a need for a system and method that minimizes the amount of storage and/or shelf space required for the dispensable substance. There is a further need for a system and method that is environmentally friendly by reducing waste that must be recycled after the material is consumed and/or minimizes the amount of wasted dispensable material. Still further, there is a need for a system that automatically mixes the exact amount of concentrated substance with a solvent at the time of use without any effort on the part of the consumer. Finally, a need exists for a spray system that can be universally attached to a standard bottle or container (e.g., a bottle of water).

The present disclosure overcomes some of the aforementioned drawbacks by providing a system and method that includes a reservoir of concentrated material and a method for attaching the reservoir to a standard water bottle and/or numerous types of bottles. The system and method disclosed herein minimizes shelf space required on a retail shelf and reduces the amount of storage space required when not being used by a consumer. Further, the system and method minimizes the environmental impact by reducing the amount of packaging and waste materials that the consumer disposes of when the materials are finished.

SUMMARY OF THE INVENTION

According to one aspect of the disclosure, a method for directing the use of a sprayer includes the step of directing a user to affix a sprayer to a neck of a water bottle via an attachment mechanism. The method further includes the step of directing the user to adjust the attachment mechanism to change the internal geometry thereof and attach the sprayer to the neck of the bottle.

According to another aspect of the disclosure, a method of directing the use of a sprayer includes the steps of directing a user to affix a monolithic sprayer with an attachment mechanism to a neck of a water bottle, wherein the sprayer includes a reservoir therein for holding a material and further includes an actuation mechanism and a nozzle, and directing the user to engage the actuation mechanism to combine the material with contents of the water bottle. The method also may include the step of directing the user to adjust the attachment mechanism to change an internal geometry thereof and to secure the attachment mechanism to the neck of the water bottle. The sprayer includes a mixing chamber configured to facilitate mixing of the material with the contents of the water bottle, and the material may be a concentrate mixable with the contents of the water bottle. For example, the material may be one or more of: a fragrance, an insecticide, a deodorizing substance, a cleaning substance, a polisher, a shining substance, a sanitizer, an air freshener, an odor eliminator, a mold or mildew inhibitor, an insect repellent, a product having aromatherapeutic properties, a flavor enhancer, a paint application, a cosmetic, a hair dye, a spray tan, or sunscreen. In this aspect, engagement of the actuation mechanism actuates a pump engine to draw contents of the water bottle into the sprayer and to draw the material out of the reservoir. Additionally or alternatively, engagement of the actuation mechanism may actuate a second pump engine to draw the material out of the reservoir.

According to another aspect of the disclosure, a method for directing the use of a sprayer includes the step of directing a user to affix a sprayer to a neck of a water bottle, wherein the sprayer includes a monolithic housing with a material reservoir therein and an attachment mechanism associated therewith.

According to a further aspect of the disclosure, a method for dispensing a dispensable substance includes the step of purchasing a sprayer having a reservoir therein, wherein the reservoir includes a concentrate. The method further includes the step of filling a bottle with a solvent and attaching the sprayer to a neck of the bottle. The sprayer is actuated, which mixes the solvent with the concentrate during actuation.

According to another aspect of the disclosure, a method of marketing or distributing a sprayer includes the step of providing a sprayer having a monolithic housing with a material reservoir therein and an attachment mechanism associated therewith at a point of purchase for a consumer. An additional step may include providing the sprayer at the point of purchase without packaging. Further, another step may include providing the sprayer with use instructions.

According to yet another aspect of the disclosure, a method of marketing a concentrated product to a customer includes the steps of providing the customer at a point of purchase with a concentrated product in a reservoir within a sprayer forming a monolithic housing, the housing having a connector, and directing the customer to using a bottle of water and attaching a neck of the bottle to the connector. The directing step may be achieved through instructions provided to the customer with the monolithic housing at the point of purchase. Additionally, the housing may be part of a kit provided to the user that also includes a second concentrated product in a second monolithic housing, the second housing including a connector, where the second concentrated product is different from the first concentrated product. Thus, the method also may include directing the customer to detach the bottle from the connector of the housing and to attach the neck of the bottle to the connector of the second housing to use the contents of the bottle to mix with the second concentrated product for a second application. The method also may include bundling the monolithic housing with one or more of: one or more additional sprayers, one or more additional concentrated products, an adapter, a dip tube, a solvent bottle, and use instructions.

According to a different aspect of the disclosure, a kit for preparing a dispensable substance is provided. The kit includes at least one sprayer having a reservoir therein that includes a concentrate. The kit optionally includes a container designed to interact with the sprayer. In some instances, the kit includes a plurality of sprayers, wherein each sprayer includes a different dispensable substance.

According to yet another aspect of the disclosure, a disposable system for spraying a material includes a monolithic housing having a container for holding a material. The system further includes an actuator and an attachment mechanism. The attachment mechanism has an adjustor for affixing the container with a first connector geometry and a second container having a second connector geometry, which is different than the first geometry.

According to still another aspect of the disclosure, a disposable system for spraying a material includes a monolithic housing having a reservoir therewithin for holding a material. The system further includes an actuator and an attachment mechanism configured to couple the monolithic housing to a container configured to hold a solvent to be mixed with the material. The system also may include a container and means for controlling a mixing ratio of the material to a solvent. The monolithic housing includes a mixing chamber configured to facilitate mixing of the material with a solvent stored within a container. The attachment mechanism includes an adjustor for affixing the monolithic housing to a container having a first connector geometry and to a second container having a second connector geometry, which is different than the first geometry. The system also includes a pump engine within the monolithic housing that may include a pump configured to draw at least one of a solvent from a container and the material from the reservoir and also may include a second pump configured to draw the material from the reservoir.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
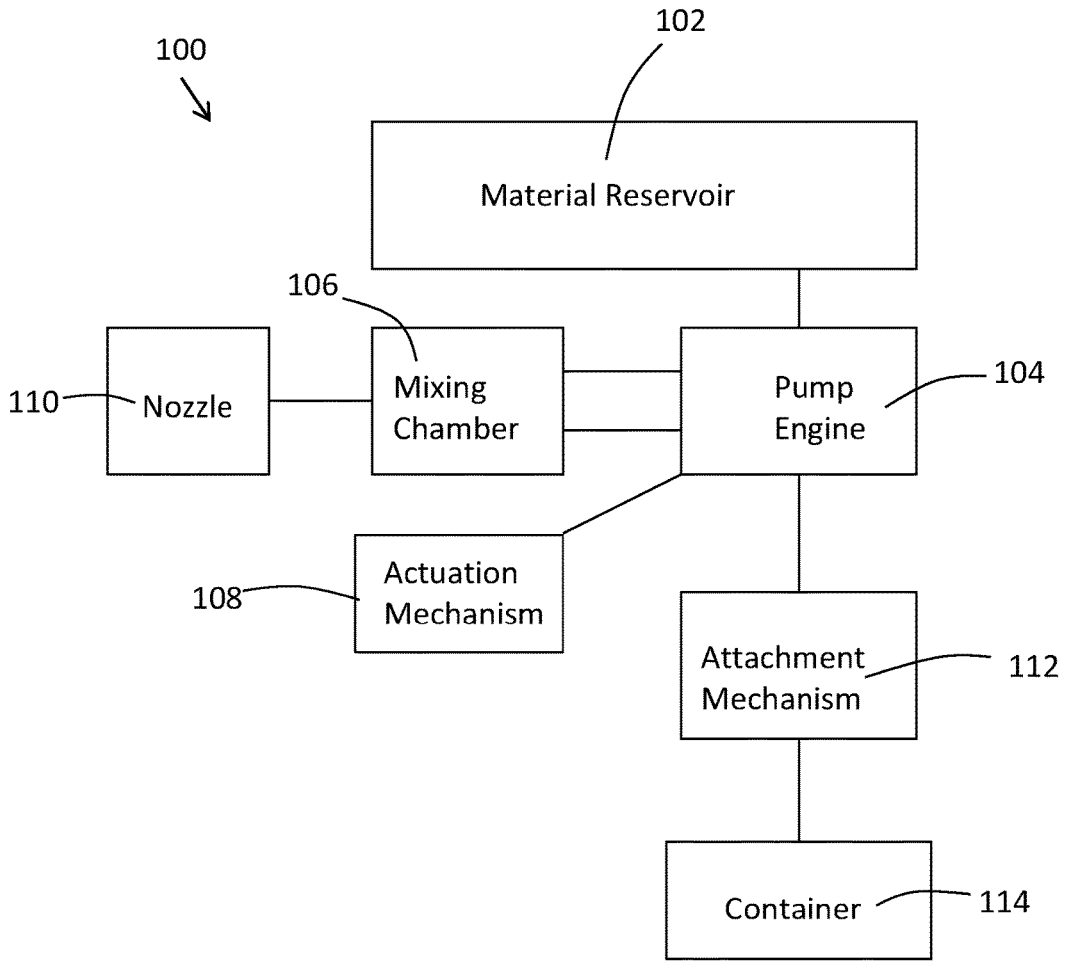
FIG. 1 is a schematic diagram of a sprayer system containing a concentrate.

Referring to FIG. 1, a schematic diagram of a sprayer system 100 is depicted. The sprayer system 100 is designed to be utilized using any of the methodologies described herein and generally includes a housing (not shown) having a material reservoir 102 therein that contains a concentrated substance (e.g., concentrate). A pump engine 104 and a mixing chamber 106 are provided with the sprayer system 100 to facilitate dispensing of the concentrate upon mixing with a solvent. The sprayer system 100 further includes an actuation mechanism 108 to facilitate dispensing, a nozzle 110 through which the substance exits the sprayer system 100, and an attachment mechanism 112 for connecting the sprayer system 100 to a container 114. The container 114 is designed to hold a solvent that mixes with the concentrate upon dispensing. The sprayer system 100 is generally described including the aforementioned components, but the sprayer system 100 may be adapted to add or remove various components according to specific embodiments.

Figure 3:
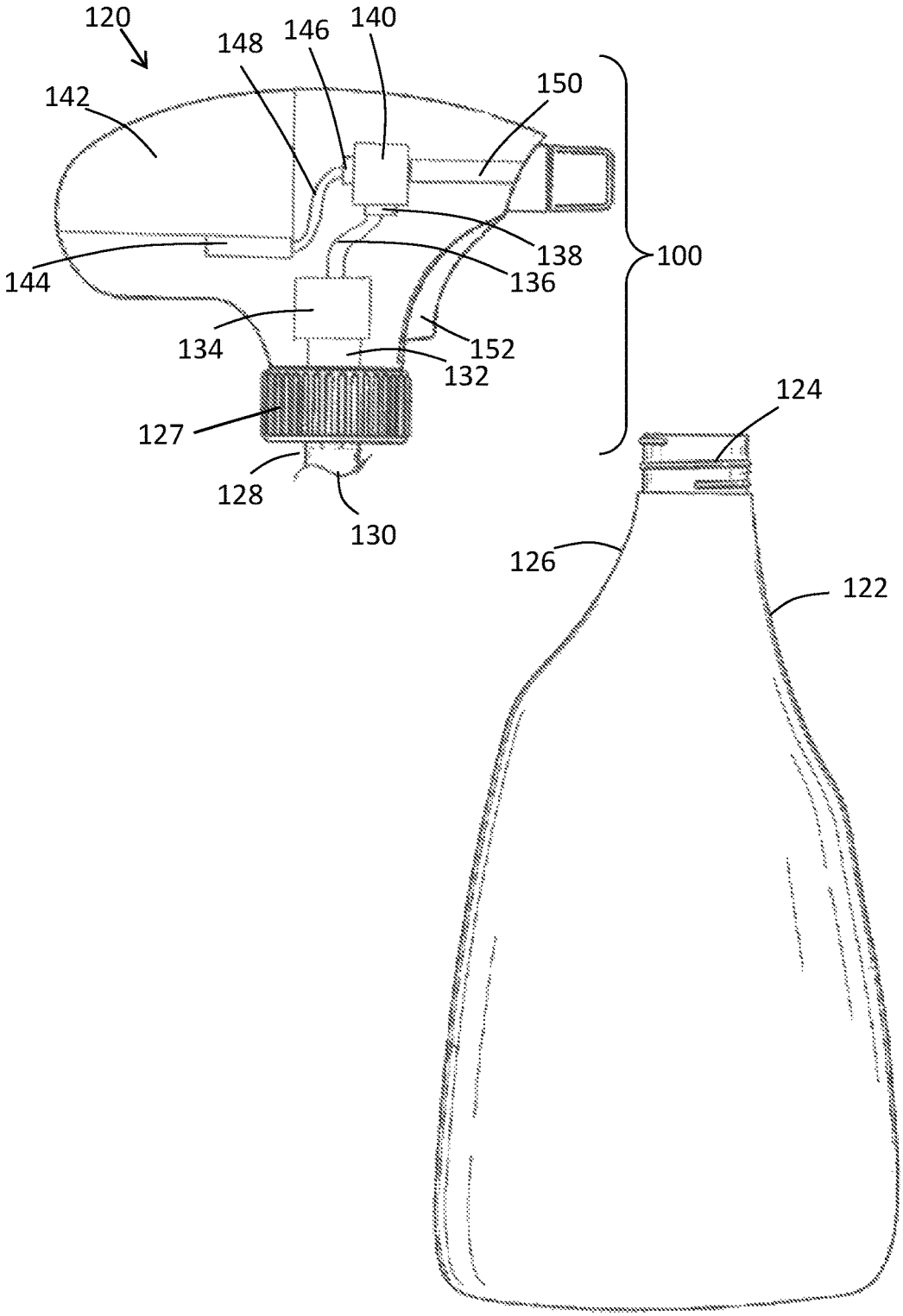
FIG. 3 is a partial schematic diagram of one embodiment of a sprayer system having a sprayer head and a container.

The sprayer system 100 generally includes a housing provided in the form of a sprayer head 120 (see e.g., FIG. 3). The sprayer head 120 provides a shell that protects and supports internal components of the sprayer system 100. In other embodiments, the internal components of the sprayer system 100 may be mounted to a support structure instead of being enclosed by the housing. In a further embodiment, the housing is defined by a structure that supports the material reservoir 102. The housing may be any shape and/or size so long as it is capable of accommodating the material reservoir 102. In one specific embodiment, the housing is monolithic and/or is provided as a single piece. It is envisioned that the sprayer head 120 is disposable and/or recyclable upon exhausting the concentrate therein and that it is not capable or readily capable of being refilled or reused. Alternatively, it is envisioned that some embodiments may be adapted to be returnable to a retail store to be refilled when empty or to be filled by a consumer in their own home.

The material reservoir 102 is provided with the sprayer system 100 to accommodate the concentrate. The material reservoir 102 preferably forms an enclosed chamber having at least one exit orifice that allows the concentrate to escape therefrom. In one embodiment, the material reservoir 102 is provided separate from the sprayer system 100. In a different embodiment, the material reservoir 102 is provided integral with the sprayer system 100. In a further embodiment, the material reservoir 102 is capable of being refilled by the consumer. In some embodiments, it is contemplated that one or more portions of the sprayer system 100, including the material reservoir 102, may be transparent to allow the consumer to visually assess the level of the concentrate within the reservoir 102.

The substance contained within the material reservoir 102 is preferably a concentrated form of a dispensable substance that is designed to be mixed with a solvent such as water. The concentrate may be that of a fragrance or an insecticide, a deodorizing and/or a cleaning substance, a polisher and/or a shining substance, or the like. The concentrate may also comprise other actives, such as a sanitizer, an air freshener, an odor eliminator, a mold or mildew inhibitor, an insect repellent, an insecticide, and/or the like, and/or have aromatherapeutic properties. Indeed, it is also envisioned that the material reservoir 102 may be used to hold a flavor enhancer for the food or beverage industry. Alternatively, the material reservoir 102 may hold a material related to the home improvement industry, e.g. a paint application. In a different embodiment a personal care material is provided in the material reservoir 102, such as a cosmetic, a hair dye, a spray tan, sunscreen, etc. In fact, the concentrate may be provided in any form within the material reservoir 102 including in solid, liquid, or gas form and may comprise any material.

The sprayer system 100 further includes the pump engine 104 and mixing chamber 106 to facilitate mixing of the concentrate and the solvent. The pump engine 104 may comprise any mechanism that facilitates the mixing in such a manner so as to mix a portion of the concentrate with a quantity of the solvent. In one embodiment, the pump engine 104 is provided in the form of a single pumping mechanism, which is known in the art. In another embodiment, the pump engine 104 may be provided by way of two separate pumps. In this embodiment, the first pump is in communication with the concentrate and the second pump is in communication with the solvent (e.g., water).

The mixing chamber 106 is designed to receive a quantity of both the concentrate and the solvent to form the dispensable substance. Each of the concentrate and the solvent are separated prior to mixing and are retained within the material reservoir 102 and the container 114, respectively. The operation of the pump engine 104 and appropriate valves (not shown) prevent the backflow of the concentrate and/or the solvent into the material reservoir 102 and/or container 114. One or more valves, conduits, and/or other components may be included in the pump engine 104 as known in the art to facilitate pumping and mixing of the concentrate and/or the solvent.

Still referring to FIG. 1, the sprayer system 100 generally includes the actuation mechanism 108 that is responsible for the mixing and/or dispensing process. In one embodiment, the actuation mechanism 108 may be a trigger attached to the sprayer head 120. In another embodiment, the actuation mechanism 108 may be provided in the form of a button, a lever, and/or one or more flanges that communicate with the internal components of the sprayer system 100. It is contemplated that the actuation mechanism 108 is in communication with one or more of the pumps, valves, and other internal components to facilitate dispensing. In one particular embodiment, numerous actuation mechanisms 108 may be provided to control one or more of the flow of the concentrate, the flow of the solvent, and the dispensing of the dispensable substance from the sprayer system 100.

The sprayer system 100 further includes the nozzle 110, which acts as an outlet orifice for the dispensable substance. The nozzle 110 may further include the mixing chamber 106 therein such that the concentrate and solvent are mixed just prior to exiting the sprayer system 100. The nozzle 110 may be provided with additional components as known in the art including, for example, a swirl chamber.

The sprayer system 100 is designed to be attached to the container 114 via the attachment mechanism 112. In one embodiment, the attachment mechanism 112 is provided in the form of one or more threads disposed on a portion of the sprayer system 100 that are designed to interact with corresponding threads on the container 114. In a different embodiment, the attachment mechanism 112 may include a malleable or semi-malleable material that deforms when the sprayer system 100 is joined to the container 114 and hardens and/or solidifies to retain the sprayer system 100 therein.

In a further embodiment, the sprayer system 100 may be provided with an adapter (not shown) that is designed to be utilized with the attachment mechanism 112 to allow the sprayer system 100 to be used with containers 114 comprising different shapes and/or sizes. The adapter may allow the attachment mechanism 112 to be affixed to the container 114 in the event that the container 114 includes a geometry that is non-uniform or non-standard (e.g., does not include a circular opening). In some embodiments, one or more adapters are provided that allows the sprayer system 100 to be utilized both with a first container having an opening with a first geometry, and a second container having an opening with a second geometry.

Figure 2:
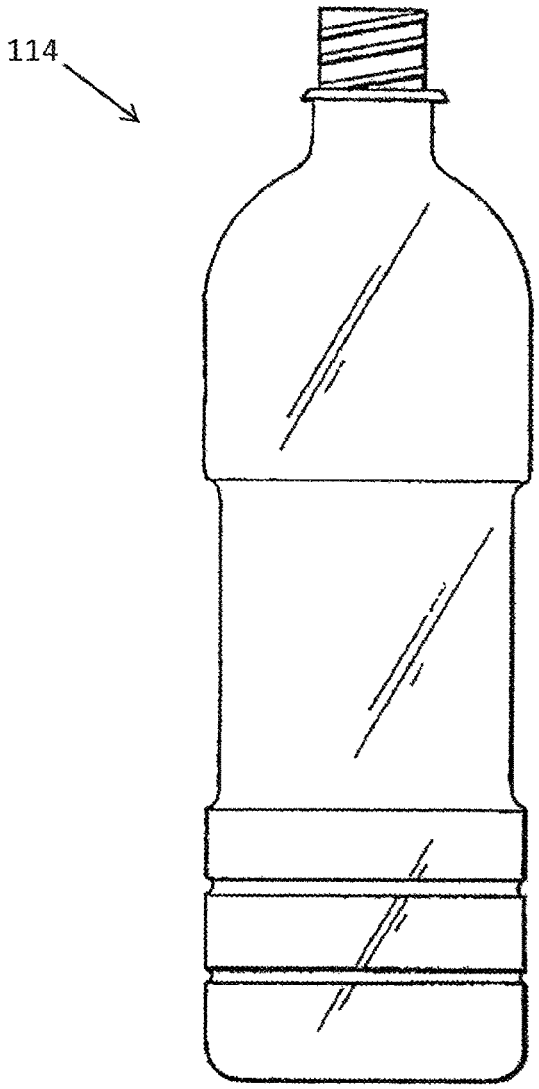
FIG. 2 is a front elevational view of a commercially available pre-packaged water bottle.

The container 114 comprises any reservoir that is capable of holding the solvent. In one embodiment, the container 114 may be provided with the solvent therein. For example, in one embodiment shown in FIG. 2, the container 114 is a commercially available pre-packaged water bottle container (e.g., Evian®, Fiji®, Aquafina®, etc). In a different embodiment, the container 114 may be provided as an empty reservoir that is designed to be filled with the solvent (see FIG. 3). The solvent may take any form, but in some embodiments is water.

Now turning to FIG. 3, one specific embodiment of the sprayer system 100 is depicted. The sprayer system 100 comprises the sprayer head 120 that is designed to be attached to a container 122 via a threaded connector. The threaded connector includes threads 124 disposed on a neck 126 of the container 122 and corresponding threads (not shown) disposed on the sprayer head 120 to facilitate attachment thereof. However, it is also contemplated that any type of connection mechanism may be used to join the sprayer head 120 to the container 122 as would be known to one of skill in the art. For example, the connector of the sprayer head 120 may include an amorphous material that conforms to the threaded neck of the container 122 to create a seal and/or a mechanism for creating an interference fit with a neck of the container 122. Further, a connector 127 of the sprayer head 120 may otherwise include an adjustable mechanism for tightening around a threaded or non-threaded portion of a container to create a fluid tight seal.

Turning again to FIG. 3, the sprayer head 120 is provided with a dip tube 128 having a distal end 130 that protrudes downwardly and is designed to be inserted into the container 122 to retrieve solvent therefrom. An opposing end 132 of the dip tube is in fluid communication with a first pump 134. A fluid passageway 136 extends from the first pump 134 and is in fluid communication with a first valve 138. A mixing chamber 140 is disposed adjacent the valve 138 and is in fluid communication therewith.

Still referring to FIG. 3, the sprayer system 100 further includes a material reservoir 142 that is in communication with a second pump 144 and a second valve 146, whereby a second fluid path 148 is formed therebetween. A discharge tube 150 extends from the mixing chamber 140 and provides an outlet for the dispensable substance at a terminal end thereof. The sprayer system 100 also includes a trigger 152 designed to actuate the first pump 134 and the second pump 144.

In use, the user connects the sprayer head 120 to the container 122 with the solvent therein (e.g., a commercial pre-packaged container of bottled water). In the embodiment shown, the container 122 and sprayer head 120 are mated via threads 124 as the container 122 and sprayer head 120 are joined and rotated as known in the art. After the sprayer head 120 is connected to the container 122, the user squeezes the trigger 152 to discharge a mixture of concentrate and water from the mixing chamber 140 through the discharge tube 150. In one embodiment, sprayer head 120 may be primed by pulling and releasing the trigger 152, which causes water to be drawn upwardly from the container 122 through the first valve 138 into the mixing chamber 140. Simultaneously, the second pump 144 draws concentrate from the material reservoir 142 through the second valve 146 and into the mixing chamber 140. The concentrate is mixed with the solvent in the mixing chamber 140 to form the dispensable substance. The dispensable substance may then be released from the mixing chamber 140 by again pulling and releasing the trigger 152.

In some embodiments, the sprayer head 120 may come pre-primed from the manufacture or the user may be required to prime the mixing chamber 140 by depressing the trigger 152 numerous times as described herein. The sprayer head 120 may optionally include a lock (not shown) that prevents the accidental discharge of materials. Further, the ratio of water to concentrate may be controlled by a variety of methods, including for example, the size of the pumps, the area of the valves, and any means known to those having skill in the art.

All of the component parts having been described, various methods associated with purchasing, distributing, and/or operating the sprayer system 100 will now be described. In particular, the sprayer system 100 may be sold at the point of purchase in a variety of ways. Broadly, a point of purchase may be a store or other retail company that sells or otherwise provides sprayer systems. Indeed, the point of purchase as used herein should be broadly interpreted to include any retailer, regardless of whether a consumer purchases or otherwise receives the sprayer system 100 for free.

Figure 4:
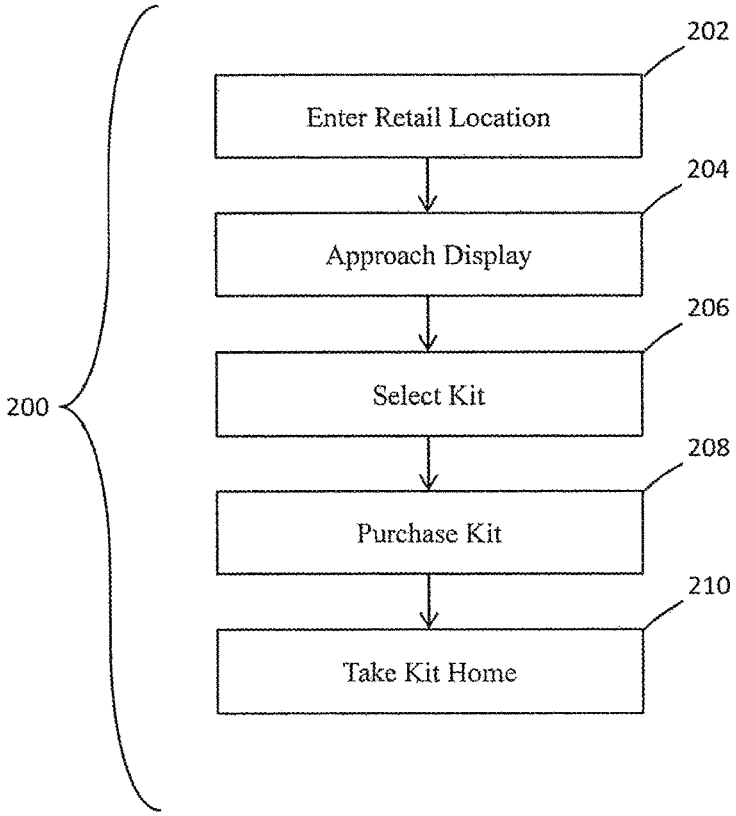
FIG. 4 is a flow chart generally depicting a method of purchasing a sprayer system according to any of the embodiments described herein.

One such method 200 is shown schematically in FIG. 4, which contemplates a consumer entering a retail location at block 202 and locating the sprayer system 100 and/or one or more components of the sprayer system 100 on a shelf or rack at block 204. At block 206, the consumer selects the sprayer system 100 and/or one or more components of the sprayer system 100 and purchases them at block 108. It is also contemplated that the sprayer system 100 and/or one or more components may be provided as a kit. After purchasing, the consumer takes the sprayer system 100, components, and/or kit to a location at block 210 where they can be utilized.

It is contemplated that the kit as used herein may solely comprise the sprayer system 100 itself without any accompanying components. It is also envisioned that the sprayer system 100 may be provided without packaging at a point of purchase, e.g., the sprayer system 100 could be hung by a portion of the system at a point of purchase or otherwise placed on a display shelf, rack, or bin. In other embodiments, the kit may comprise a sprayer system 100 that is provided in packaging and/or bundled with other components, e.g., one or more additional sprayers, an adapter, a dip tube, a solvent bottle, use instructions, etc.

It is further contemplated that non-traditional points-of-purchase may be utilized to increase the flexibility and convenience of the sprayer system 100 to consumers. For example, a traditional retailer having a physical store location may be replaced with an internet portal. In this instance, consumers could order a kit or kits that are predetermined by the manufacturer. Supplying the sprayer system 100 in this manner would be significantly less expensive than supplying a traditional dispensable product as known in the art due to the decreased size and weight of the sprayer system 100 described herein. Alternatively, a consumer could use the internet portal to create a custom kit with one or more of the sprayer system 100 components and concentrate as desired.

In a different embodiment, the sprayer system 100 is provided in a vending machine at locations with location-appropriate concentrated products. For example, a vending machine at a car wash could include sprayer system 100 kits with concentrated materials appropriate for cleaning and/or detailing automobiles. Alternatively, a traditional retail display could be replaced with an automated vending machine that could allow the consumer to select custom concentrated material properties and fill a sprayer system 100 with custom mixed concentrated materials. The consumer could then purchase the customized sprayer system 100 in the normal manner.

The sprayer system 100 and/or container 122 may be supplied to the consumer using a variety of distribution methods. For example, in one embodiment, the sprayer system 100 is distributed as a stand-alone sprayer head 120. The sprayer head 120 contains a concentrate disposed therein. In this embodiment, the consumer supplies the container 122 and solvent (e.g., a prepackaged bottle of water). In a different embodiment, the sprayer system 100 is distributed as a multi-pack kit of one or more sprayer heads 120 that contain different concentrates. In a further embodiment, the sprayer system 100 is distributed as a kit that includes one or more sprayer heads 120 and one or more containers 122. The container(s) 122 optionally includes the solvent(s) therein. The kit may include one container 122 and a plurality of sprayer systems 100 such that the container 122 is able to be reused with each of the sprayer systems 100. In a further embodiment, an adapter may be included in any of the kits described herein to allow the sprayer system 100 to fit a variety of containers 122.

In some embodiments, the sprayer system 100 and/or kit may include instructions for use associated therewith. The instructions may be printed on the kit directly and/or may be supplied separately. In other embodiments, intuitive symbols may be utilized that direct the consumer to mate the sprayer system 100 with the container 122. It is also contemplated that one or more of the sprayer system 100 or kit may include a scan bar thereon that is compatible with a user's cellular phone, which would allow a user to pull up instructions, receive a promotional offer, view a video demonstration, receive information, etc.

Figure 5:
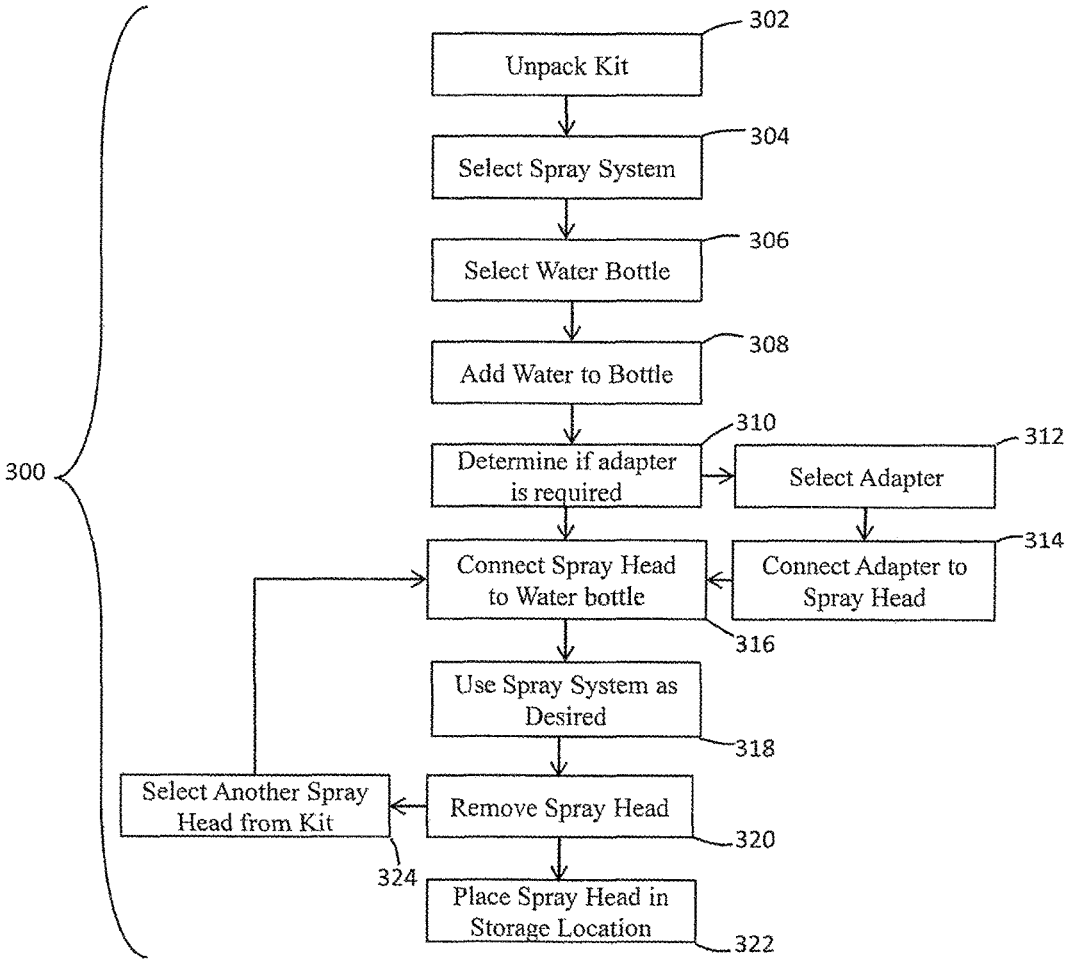
FIG. 5 is a flow chart generally depicting a method of using a sprayer system according to any of the embodiments described herein.

After purchasing, the consumer is ready to prepare and use the sprayer system 100 according to one or more of the methodologies described herein. For example, one method 300 for preparing and using the sprayer system 100 is depicted in FIG. 5. In a first step, the consumer unpacks the sprayer kit at block 302 and selects a sprayer system 100 to be used at block 304 according to the desired task. The consumer then selects a bottle (either provided by the consumer or included in the kit) at block 306. In a preferred embodiment, the bottle is a water bottle, but any bottle containing a solvent may be used. If the water bottle is empty, the consumer adds water to the bottle at block 308. Next, at block 310, the consumer needs to decide if the sprayer system 100 attaches directly to the bottle, or if a connecting adapter is required. To make this determination, the consumer may visually inspect the fitting or test fit the spray head on the bottle. If a connecting adapter is required, the appropriate adapter can be selected at block 312 and attached to the spray head at block 314. If the connecting adapter is not required, the consumer can directly attach the sprayer system 100 to the bottle. At block 316, the sprayer system 100 is attached to the bottle either directly, or using the connecting adapter, and is ready to be used. In a different embodiment, steps 310-314 may be eliminated by use of a universal or multi-bottle adapter provided on the spray system 100 that can connect with various bottle geometries. The spray system 100 is used as desired at block 318. When dispensing is complete, the consumer can remove the spray head from the bottle at block 320. The consumer may optionally place the spray head in storage with the rest of the kit at block 322. Optionally, at block 324, the consumer may select a different spray head as desired and follow the same process to utilize the sprayer system 100.

As discussed previously, there are significant advantages of the sprayer system described herein as compared to sprayer systems of the prior art. For instance, one advantage is that the amount of shelf space or display space required to display and/or store the sprayer system is significantly less than that of typical cleaning and/or dispensing solutions. As a result, a larger variety of sprayer systems are able to be displayed and/or stored.

Additionally, the sprayer system disclosed herein does not require that the consumer premix the concentrate with the water. Rather, the sprayer system mixes the correct amount of concentrate with each actuation of the spray head. Further still, the user can change between concentrated materials simply by replacing the spray head attached to the bottle. For example, after using a spray head containing a concentrated disinfectant spray, the user can remove the spray head and attach another spray head with glass cleaner without any concern about mixing chemicals or having to clean the bottle.

Still further, the sprayer system of the present disclosure is environmentally friendly, simple to construct, and requires minimal materials. Once the concentrated material is consumed, the spray head can easily be disposed of and/or refilled. There is less waste material in the sprayer system disclosed herein because the consumer is not required to premix the material and/or guess at the quantity that may be needed. It is envisioned that used spray systems could be recycled and reused after being collected by the manufacturer or distributor at retail locations. Alternatively, the spray system could be made of largely bio-degradable materials and placed in the trash when empty. The spray systems of the present disclosure may be configured in a variety of embodiments to promote the environmental friendliness of the product.

Any of the embodiments described herein may be modified to include any of the structures or methodologies disclosed in connection with different embodiments. Further, the present disclosure is not limited to concentrated material spray systems of the type specifically shown. Still further, the concentrated material spray systems of any of the embodiments disclosed herein may be modified to work with any type of spray system that utilizes concentrated materials.

INDUSTRIAL APPLICABILITY

A sprayer system is presented that dispenses a mixture of concentrate and water into the surrounding environment through a discharge tube. The spray system is adapted to mix water and concentrated materials in precise amounts. Thus, a consumer may experience the convenience of using a concentrated product without having to premix the concentrated material and water.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A system for spraying a material, comprising:

a nozzle;

a disposable single piece housing having a reservoir therewithin for holding a material, a mixing chamber, and a discharge tube extending from the mixing chamber and providing an outlet;

an actuator; and an attachment mechanism configured to couple the single piece housing to a container configured to hold a solvent to be mixed with the material.

2. The system of claim 1, further comprising the container.

3. The system of claim 1, the attachment mechanism comprising:

a connector for affixing the single piece housing to a threaded connector of the container.

4. The system of claim 1, wherein the mixing chamber is configured to facilitate mixing of the material with the solvent stored within the container.

5. The system of claim 4, wherein the solvent passes through a first valve and into the mixing chamber and the material passes through a second valve and into the mixing chamber.

6. The system of claim 5, wherein the ratio of solvent to material is controlled by the area of the first valve and the area of the second valve.

7. The system of claim 1, further comprising a pump engine within the single piece housing.

8. The system of claim 7, wherein the pump engine includes a first pump configured to draw at least one of the solvent from the container and the material from the reservoir.

9. The system of claim 8, wherein the pump engine includes a second pump configured to draw the material from the reservoir.

10. The system of claim 9, wherein the ratio of solvent to material is controlled by the size of the first pump and the size of the second pump.

* * * * *